US005311847A

United States Patent [19]

Boehning

[11] Patent Number: 5,311,847

[45] Date of Patent: May 17, 1994

[54] FLATHEAD ADAPTION SYSTEM FOR ENGINE

[76] Inventor: Jack Boehning, 13037 S. Park Ct., Crestwood, Ill. 60445

[21] Appl. No.: 126,605

[22] Filed: Sep. 27, 1993

[51] Int. Cl.[5] ..... F01M 9/10

[52] U.S. Cl. ..... 123/90.38; 123/195 C; D15/5

[58] Field of Search ..... 123/90.38, 195 C; D15/5

[56] References Cited

U.S. PATENT DOCUMENTS

D. 252,878 9/1979 Bellino et al. ..... D15/5

D. 305,767 1/1990 Tauschke ..... D15/5

*Primary Examiner*—Noah P. Kamen

*Attorney, Agent, or Firm*—Hill, Steadman & Simpson

[57] ABSTRACT

A flathead adaption system for an engine adapts the engine to look like a 1950's flathead engine. First the existing valve cover is removed from the engine. Thereafter, an adapter member is mounted at a valve cover opening from which the valve cover was removed. A rectangular plate-shaped flathead member is mounted to the top surface of the adapter member covering over the valve cover opening. The flathead member is provided with a plurality of non-energized spark plugs. When one or more of these non-energized spark plugs is removed, the resulting aperture is then used for pouring oil into the engine in place of the oil filling aperture in the valve cover which was removed.

19 Claims, 2 Drawing Sheets

FLATHEAD ADAPTION SYSTEM FOR ENGINE

BACKGROUND OF THE INVENTION

In the 1950's, engines such as small block Ford engines employed what was known as a "flathead" on the engine block. With such flathead engine blocks, the head was flat and had ribs protruding therefrom along with spark plugs. The flathead design became obsolete when internal combustion engines underwent changes whereby the valve lifters and push rods were moved so that they protruded near the top left and right sides of the engine while the spark plugs at the ends of the cylinders protruded at intermediate sides of the engine block. Present day internal combustion engines such as for automobiles thus are generally arranged in a shape as approximately shown in prior art FIG. 1 by reference numeral 10.

Car enthusiasts are attracted to the nostalgic "early days of hot-rodding" look of the flathead engine design of the 1950's. However, such engines are rare and expensive to obtain and install.

SUMMARY OF THE INVENTION

It is an object of the present invention to provide the 1950's "flathead look" without the need of actually purchasing and installing such an old style 1950's engine in an automobile.

According to the invention, a flathead adaption system is provided for retrofitting or converting relatively current production internal combustion engines such as small or large block Chevrolet or Ford engines so that they will have the nostalgic "flathead look" of the 1950's. With the present invention, a flathead member is provided which, together with an adapter member, replaces valve covers on a current production engine. The adapter member together with the flathead member thus form a replacement valve cover. The flathead member preferably has ribs and protruding spark plugs arranged to look like the 1950's flathead. The spark plugs are "dummy" spark plugs which are not actually electrically connected and/or fired. However, by unscrewing one or more of the spark plugs, the aperture from which the spark plug or plugs was unscrewed may then be used as an oil filling aperture in place of the oil filling aperture on the valve covers which have been removed and replaced with the flathead member and adapter member.

DESCRIPTION OF THE PREFERRED EMBODIMENTS

Figure 1:
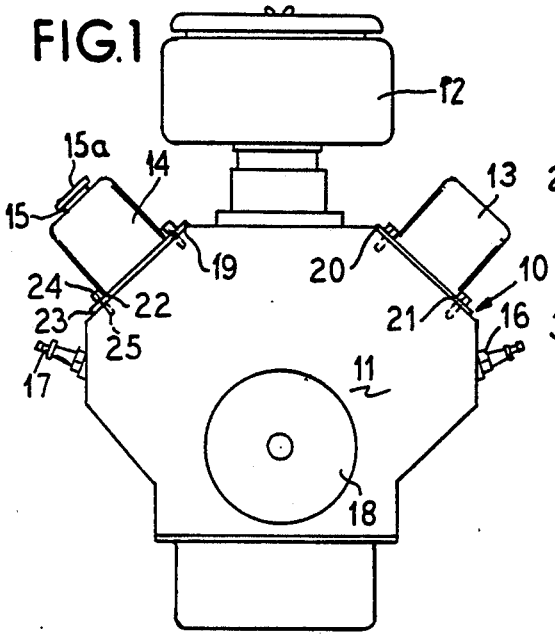
FIG. 1 is an end view from the front of a typical current production internal combustion engine such as in an automobile, and which has two valve covers.

To provide a full understanding of the invention, first a typical prior art current production engine will be described with reference to FIG. 1. Such a conventional engine is generally illustrated at 10 and is formed of an engine block 11 having a carburator and air cleaner assembly 12 at the top thereof. Pocket-shaped valve covers 13 and 14 are provided at either side of the air filter system 12 on slightly sloping side walls 19 and 20 of the engine block 11. Typically one of the valve covers such as 14 has an oil filling aperture 15 with a cap 15*a* thereover.

On side walls of the engine block 11 rows of spark plugs 16 and 17 are provided. At the front of the engine block, a pulley 18 is shown connected to a crank shaft protruding from the engine.

On the sloping side walls 19 and 20, the valve covers 13 and 14 are respectively mounted over slot-shaped openings 21 and 22 at which the valve rocker arms are located. Valve covers are retained at these apertures by bolts 24 passing through a side flange 23 on each valve cover and into a threaded hole 25.

Figure 2:
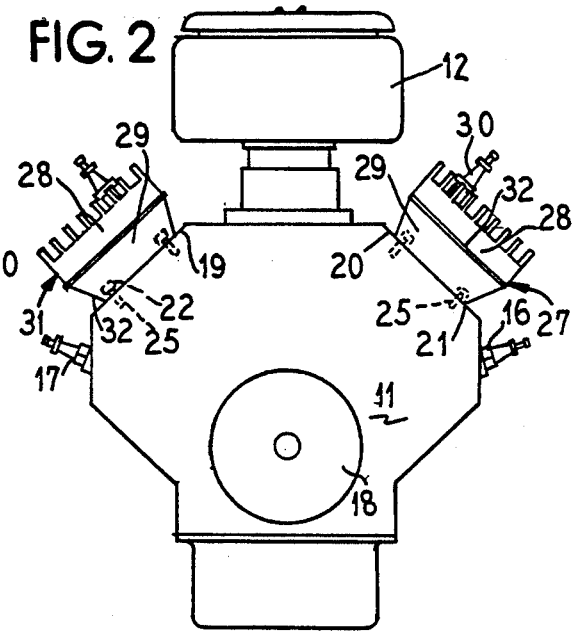
FIG. 2 is a front end view of the engine of FIG. 1 with the flathead adaption system according to the invention in place on the engine.

The invention will now be explained with reference to FIG. 2. In FIG. 2, the same engine as illustrated in FIG. 1 is shown, but with the valve covers 13 and 14 removed and the flathead adaption system of the invention as generally shown at 27 and 31 in place of the valve covers 13 and 14. The flathead adaption system includes a plate-shaped rectangular flathead member 28 bolted to an adapter member 29 which is also bolted to the engine block 11 so as to cover the slot-shaped opening 21. Similarly, the flathead adaption system 31 at the left side of the engine is also formed of a plate-shaped member 28 and adapter member 29.

Using at least some of the same threaded holes 25, the adapter members are fastened with bolts 32 at the inside of the adapter members 29. The plate-shaped flathead member 28 is attached to the adapter member 29 by bolts 36 and 37 as shown in FIG. 3.

Figure 3:
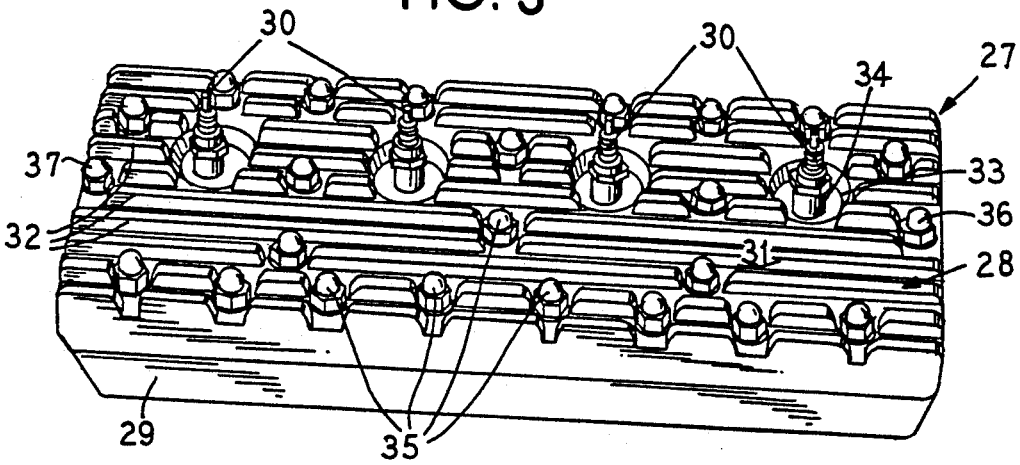
FIG. 3 is a perspective view from the top of the flathead adaption system of the invention.

Each of the flathead members 28 has a plurality of non-energized spark plugs 30 screwed into receiving apertures 34 at the bottom of pocket-like recesses 33, as shown in FIG. 3. These spark plugs are not actually fired, but are for appearance to simulate the 1950's flathead appearance. However, if one or more of these spark plugs 30 is unscrewed, the opened aperture 34 may then be used to fill the engine with oil in lieu of the oil filling aperture 15 in the conventional valve cover as shown in FIG. 1.

As shown in FIG. 3, the flathead member 28 has a plurality of longitudinally extending ribs 32 and a plurality of dome-shaped bolts 35. These bolts are not used, with the exception of the end bolts 36 and 37, and are for appearance purposes to simulate the 1950's flathead look.

Figure 4:
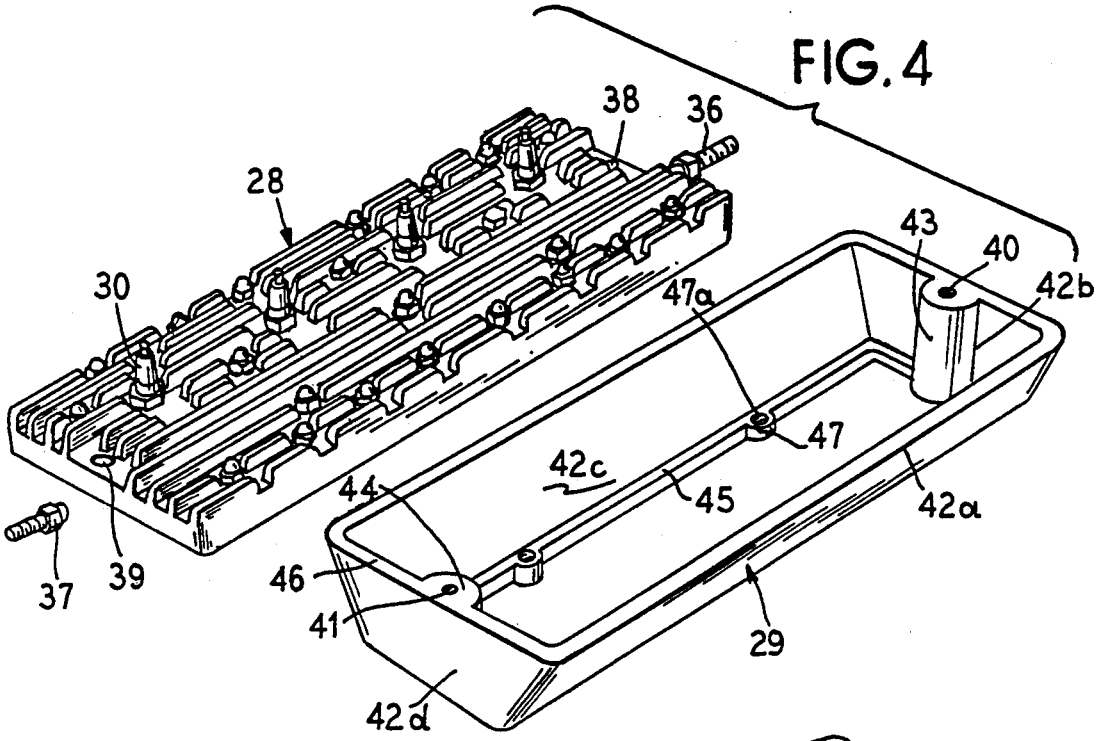
FIG. 4 is a perspective view of the disassembled flathead adaption system of the invention.

In the disassembled perspective view of FIG. 4, the screws 36 and 37 are shown removed so that the flathead member 28 is disassembled from the adapter member 29. The adapter member 29 has slanting or skirting side walls 42*a, b, c, d* which slant inwardly from the flat member attachment surface on top down to an inwardly facing circumferential flange 45 which bolts at the respective valve cover aperture 21 or 22. This inwardly circumferential flange 45 has widened portions or ears 47 each with an aperture 47*a* used to bolt the adapter member 29 in the existing threaded apertures 25 within the engine block at the valve cover apertures.

As shown in FIG. 4, only the outer walls 42*a* and 42*c* are slanting, whereas the end walls 42*d* and 42*b* are vertical. At an inner surface of these vertical walls 42*b*, 42*d*, a support pillar 43 and 44 each having respective mounting apertures 40 and 41 therein are provided for receiving the bolts 36 and 37 which hold the flathead member in place on top of the adapter member 29.

Figure 5:
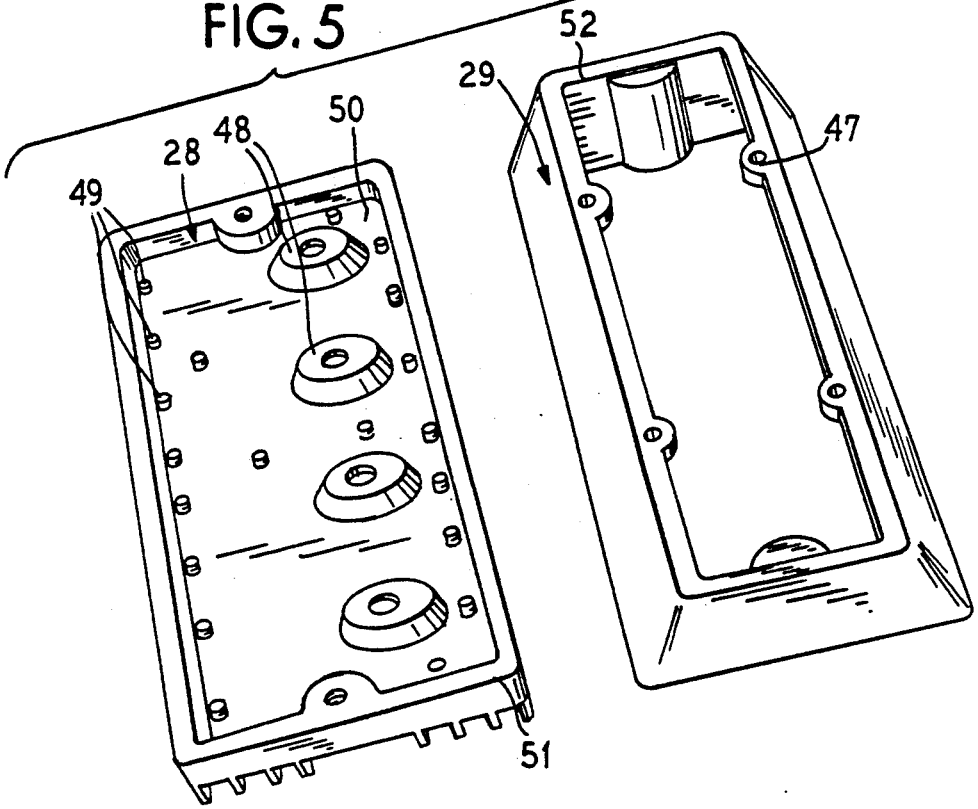
FIG. 5 is a perspective view of the disassembled flathead adaption system of the invention viewed from the bottom.

As shown at FIG. 5, the bolts 35 are threaded through the plate-shaped flathead member and provide the "look" of the 1950's flathead. Also, the bottom of the recesses 33 holding the spark plugs 30 can be seen in FIG. 5 as shown at 48. 49 illustrates the threaded apertures holding the bolts 35. Finally, as shown at 50, the bottom of the flathead member is formed as a pocket with an outer mating surface 51 which abuts against a surface 52 on the adapter member.

As is evident in FIG. 3, the row of spark plugs 30 is offset to one side of a longitudinal center line of the flathead member 28.

Preferably, both the flathead member and the adapter member are constructed of cast aluminum. This cast aluminum structure can be finished in a variety of ways such as by polishing, painting, or a combination of both.

With the flathead adaption system according to the invention, full engine breathing capabilities in a unique oil filling system is provided, while at the same time accomplishing a truly ultimate and unique engine accessory for the car enthusiast who wishes to provide an engine which is reminescent of the 1950's flathead look.

Although various minor changes and modifications might be suggested by those skilled in the art, it will be understood that I wish to include within the scope of the patent warranted hereon all such changes and modifications as reasonably come within my contribution to the art.

I claim as my invention:

1. A flathead adaption system for an engine having at least one valve cover and at least one spark plug extending from the engine at a location separated from the valve cover, comprising:

a rectangular plate-shaped flathead member having at least one non-energized spark plug therein; and an adapter member having a first mounting surface at which the flathead member is attached and an opposite second mounting surface which is attached at a valve opening in an engine block of the engine in place of a valve cover which is removed prior to mounting of the flathead member and adapted member.

2. A system according to claim 1 wherein the plate-shaped flathead member comprises an oil filling aperture which is an aperture for receiving the non-energized spark plug.

3. A system according to claim 1 wherein the flathead member has longitudinally extending ribs at an outer facing surface thereof and a plurality of non-energized spark plugs.

4. A system according to claim 3 wherein each of the non-energized spark plugs is provided in a pocket-like recess.

5. A system according to claim 1 wherein a plurality of hemispherically shaped bolts are provided in apertures in a plurality of locations on the flathead member.

6. A system according to claim 1 wherein the flathead member is attached to the first mounting surface of the adapter member by first and second bolts at outer longitudinal ends of the flathead member.

7. A system according to claim 1 wherein the adapter member has sloped inwardly facing longitudinal side walls and opposite vertical end walls so as to define a rectangular opening corresponding to an opening in the engine block at which valves are located.

8. A system according to claim 1 wherein said adapter member has at said second mounting surface an inwardly facing flange having mounting apertures therein and bolts through said mounting apertures mounting said adapter member to said engine block.

9. A system according to claim 1 for an engine block having two longitudinally extending rectangular valve cover openings and wherein adapter member and corresponding flathead member are adapted to be mounted over each of the valve cover openings.

10. A system according to claim 1 wherein a row of spark plugs is provided in the flathead member laterally offset to one side of a longitudinal center line of the flathead member.

11. A method for adapting an engine having at least one pocket-shaped valve cover to look like a 1950's flathead engine, comprising the steps of:

removing the at least one valve cover from a valve cover opening;

mounting an adapter member at the valve cover opening; and mounting a rectangular plate-shaped flathead member to a top surface of the adapter member covering over the valve cover opening.

12. A method according to claim 11 including the step of providing said flathead member with a plurality of non-energized spark plugs.

13. A method according to claim 11 including the steps of providing the plate-shaped flathead member with a plurality of non-energized spark plugs and filling the engine with oil by removing at least one of the non-energized spark plugs and pouring the oil through an aperture which receives the non-energized spark plug.

14. A method according to claim 11 including the steps of providing the plate-shaped flathead member with a plurality of longitudinally extending ribs and a row of non-energized spark plugs, and also providing a plurality of bolts visible at a top of the flathead member.

15. A method according to claim 14 including the step of providing the bolts with a hemispherical shape and providing the spark plugs in pocket-like recesses among the ribs in a line along a longitudinal extent of the flathead member.

16. A method according to claim 11 including the step of using at least some of the same screw holes used to mount the removed valve cover in mounting the adapter member.

17. An automobile engine having a 1950's flathead engine appearance, comprising:

an engine block having first and second rows of energized spark plugs extending from respective opposite outer side walls thereof;

first and second valve cover openings extending at opposite sides of a central top surface of the engine block;

first and second adapter members having sloped inwardly facing side walls having respective bottom surfaces bolted at the respective valve cover openings; and first and second plate-shaped flathead members each having a row of non-energized spark plugs therein mounted at a top surface of each of the respective first and second adapter members.

18. An engine according to claim 17 wherein each of the flathead members has a plurality of longitudinally extending ribs outwardly from a top surface of the flathead member.

19. A flathead adaption system for an engine having at least one valve cover and at least one energized spark plug extending from the engine at a location separated from the valve cover, comprising:

a rectangular plate-shaped flathead portion having at least one non-energized spark plug therein;

an adapter portion having at one end the flathead member portion thereat and at an opposite end being attachable at a valve opening in an engine block of the engine in place of a valve cover which is removed prior to mounting of the flathead member and adapter member.

* * * * *